US006641023B2

(12) United States Patent
Strååt et al.

(10) Patent No.: US 6,641,023 B2
(45) Date of Patent: Nov. 4, 2003

(54) ANTI-REVERSING DEVICE IN A STAPLE MAGAZINE

(75) Inventors: Olle Strååt, Hestra (SE); Marcus Börjesson, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/064,393

(22) Filed: Jul. 9, 2002

(65) Prior Publication Data

US 2003/0010804 A1 Jan. 16, 2003

(30) Foreign Application Priority Data

Jul. 9, 2001 (SE) ..... 0102443

(51) Int. Cl.[7] ..... B25C 5/16

(52) U.S. Cl. ..... 227/121; 227/120; 227/131

(58) Field of Search ..... 227/8, 120, 121, 227/131, 155

(56) References Cited

U.S. PATENT DOCUMENTS

| | | | | | |
|---|---|---|---|---|---|
| 3,524,575 | A | * | 8/1970 | Hurkmans et al. | 227/7 |
| 4,588,121 | A | * | 5/1986 | Olesen | 227/120 |
| 4,623,082 | A | * | 11/1986 | Kurosawa | 227/7 |
| 4,993,616 | A | * | 2/1991 | Yoshie et al. | 227/120 |
| 5,230,457 | A | * | 7/1993 | Hiroi et al. | 227/2 |
| 5,273,199 | A | * | 12/1993 | Logtens | 227/87 |
| 5,794,833 | A | * | 8/1998 | Strååt | 227/137 |

* cited by examiner

*Primary Examiner*—Scott A. Smith
*Assistant Examiner*—Nathaniel Chukwurah
(74) *Attorney, Agent, or Firm*—Howrey Simon Arnold & White LLP

(57) ABSTRACT

An anti-reversing device in the feed channel of a staple magazine containing staple blanks (ii), which magazine is accommodated in a stapler, wherein the staple blanks advance along a feed channel having channel guides (22) which support the staple blanks and wherein the supporting channel guides are equipped with stops (26) which prevent a staple blank which has advanced past the stops from moving in the direction opposite to the direction of feed.

4 Claims, 6 Drawing Sheets

Vy A-A

Vy B-B

ANTI-REVERSING DEVICE IN A STAPLE MAGAZINE

CROSS REFERENCE TO RELATED APPLICATIONS

The present application claims priority to Swedish Patent Application No. 0102443-9 filed Jul. 9, 2001. Said application is expressly incorporated herein by reference in its entirety.

BACKGROUND OF INVENTION

1. Technical Field

The present invention is concerned with an anti-reversing device fitted in a staple magazine with is accommodated in a stapler and which contains elongated staple blanks which are separably joined with each other along their long sides to form a continuous web. The separable joint is disposed along the midsection portions of the staple blanks. The outer sections of each staple blank are capable of limited movement relative to the outer portions of adjacent staple blanks and to their own aforementioned midsections portion in a direction which is traverse to the lengthwise direction of the web. In use, the staple blanks are advanced stepwise by a feed device along a feed channel out of a containing magazine, one at a time, via a outlet opening from the magazine. The feed channel consists of at least first and second channel guides on which the continuous web of the staple blanks advances. The first and second channel guides are positioned so that each supports a respective outer portion of the web. A third channel guide is provided that, along the center portion of the web, abuts closely thereon at an opposite to the side of the web that is supported by the first and second channel guides.

2. Background of the Invention

Staple magazines of the type described above are known. Since forces arise that act on the web in a direction that is opposed to the feed direction out of the magazine, it has been found necessary to provide the magazine with an anti-reversing device that counteracts these opposed forces. Such anti-reversing devices have been known to consist of a piece of a material exhibiting an edge which is tensioned against the web and engages in the interstices between the joined staple blanks. The drawback of these devices, however, has been that they are difficult to mount correctly, resulting in their intended functionality not being attained. Moreover, because the piece of material is most often fabricated of metal while the magazine consists primarily of plastic, it is more difficult to recycle the magazine after the staple blanks are spent. Since the piece of material would first have to be separated from the magazine before recycling can take place, a process generally considered to be difficult, result is frequently that no recycling takes place of any of the magazine.

SUMMARY OF THE INVENTION

The present invention obviates the above-mentioned drawbacks by the inclusion of a reversing device in which the first and the second channel guides exhibit, at equal distances from the outlet opening at the inside of the magazine, respective integrated stops which, as the web of staples is advanced, force the outer sections of each staple blank to bend resiliently upwards relative to a center portion thereof as the staple blank passes over the substantially parallel stops. After passing over the stops, the two outside portions regain their original configuration once the stops are passed. In this way, as a staple blank feeds past the stops, it is prevented by the stops from moving in the direction opposite to the direction of feed.

The invention is further characterized in that each stop projects above a top surface of its respective channel guide to a height equal to at least half the height of a staple blank.

Still further, each stop is of substantially triangular cross-sectional shape, when taken in an elevational view, with one side of the triangle coinciding with the top of the associated channel guide, and the side nearest to the outlet opening having a rake angle not exceeding 90 degrees relative to the side coinciding with the top of the channel guide.

The present invention is further characterized in that the rake angle may range between 70 and 110 degrees.

BRIEF DESCRIPTION OF DRAWINGS

A preferred embodiment of the invention will be described below with reference to the attached figures, wherein.

DETAILED DESCRIPTION

Figure 1:
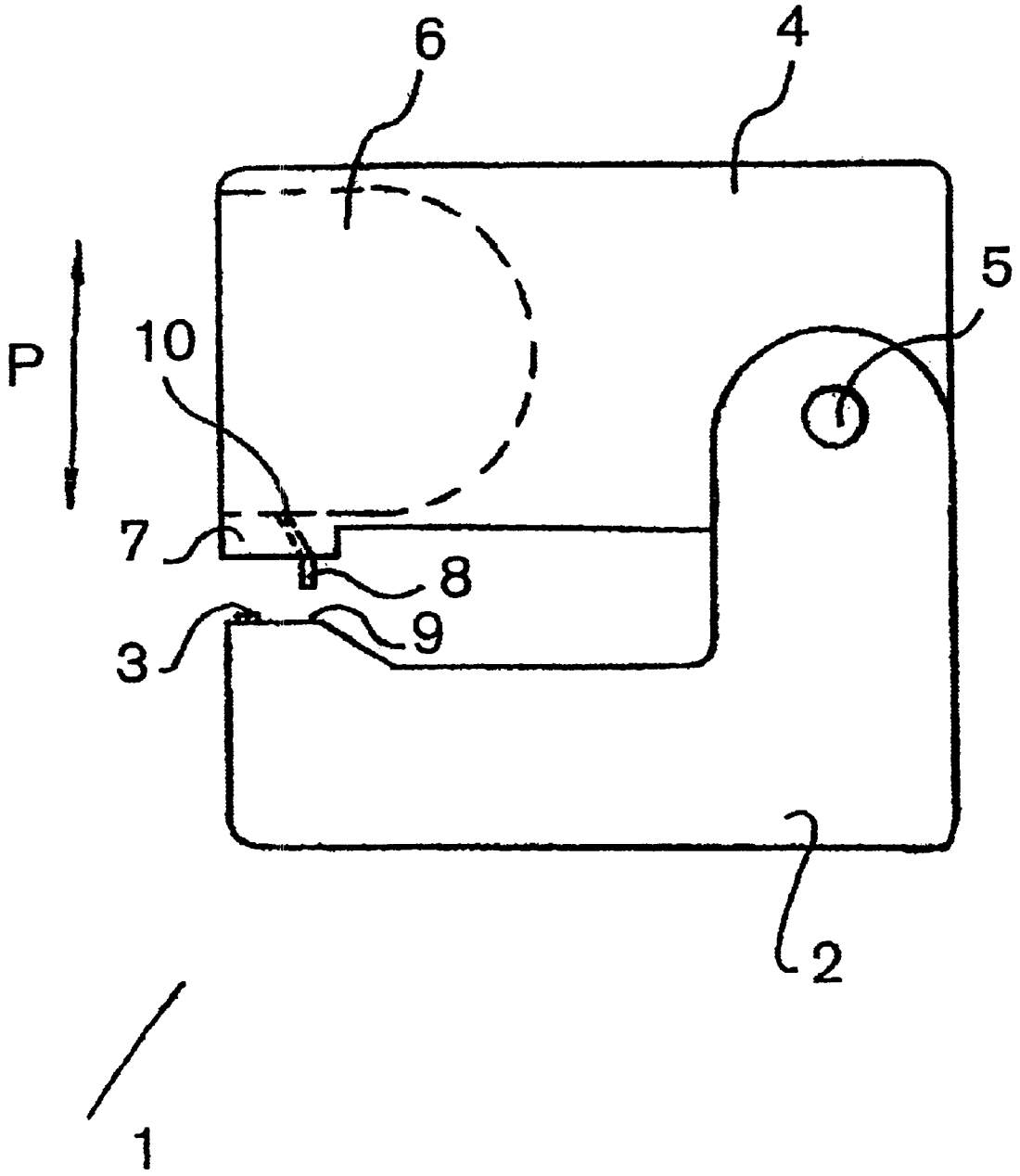
FIG. 1 is a schematic view of a stapler.

FIG. 1 shows a stapler 1 that includes a base 2 upon which an anvil 3 is mounted. A stapler head 4 is pivotably mounted on the base 2 via a pin or spindle 5. Disposed on the stapler head 4 is a staple magazine 6 and a feed device 7, both of which are indicated schematically in FIG. 1. The feed device 7 operates in such a manner that when the stapler head 4, which can be pivoted relative to the base 2 in the directions indicated by the double-headed arrow P, is pressed downwards in a stapling action, the pin 8 strikes a surface 9 on the base whereupon the pin 8 is forced into the feed device 7 and actuates the feeding plate 10. This advances, by one step, the web of staple blanks housed in the staple magazine 6.

Figure 2:
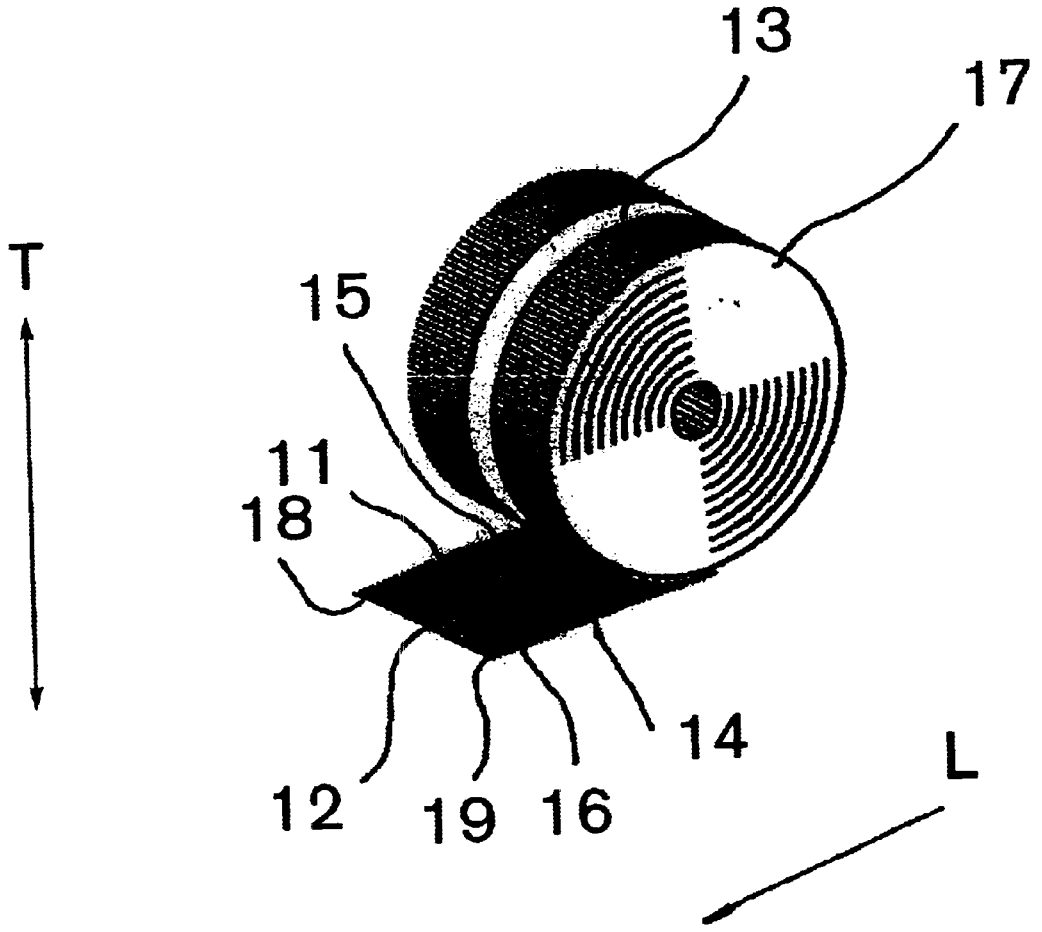
FIG. 2 shows a web consisting of staple blanks, which web has been formed into a roll.
Figure 4:
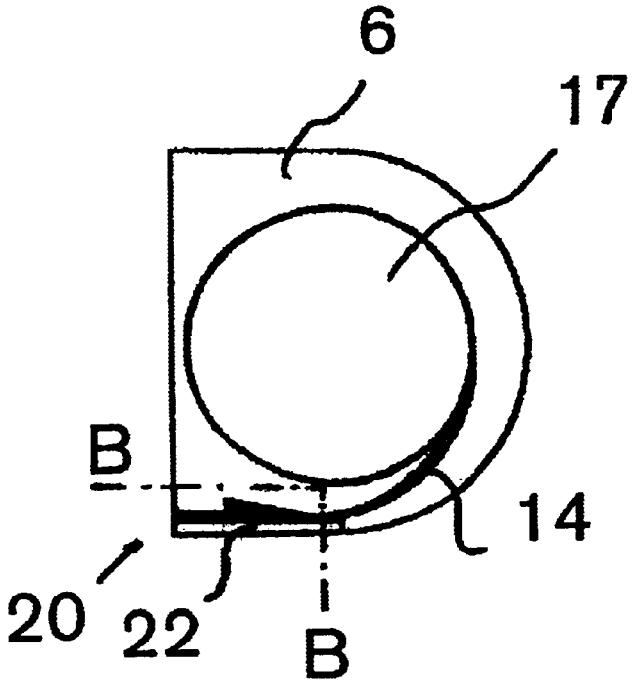
FIG. 4 is a schematic cross-sectional view taken along line AA in FIG. 3.

FIG. 2 shows a number of elongate (length-wise) staple blanks 11 that are separably joined along their mid-sections 12 by a binding or bonding means 13, which can exemplarily take the form of glue, adhesive tape, and other suitable means. When bonded or joined together, the several, or plurality of staple blanks 11 form an elongate and substantially continuous web 14 (elongate and substantially continuous in a direction substantially perpendicular to the length-wise axis of the staple blanks 11) having a top side 15 and an underside 16. The web is arranged to form a staple roll 17. Inasmuch as the staple blanks 11 are joined together at their mid-sections only, their respective outer portions 18 and 19 are capable of limited movement relative to their mid-sections in the direction of the double arrow T; a direction which is substantially transverse to the lengthwise direction of the web 14, a direction that is indicated by the arrow L. As shown in FIG. 4, the web 14, formed into a staple roll 17, is stored in the staple magazine 6. As will be readily apparent to those familiar with this art, the web 14 may also be stored in a stack consisting of a plurality of webbed segments; it will be similarly apparent that in such a case, the magazine will be of an appropriately modified configuration.

Figure 3:
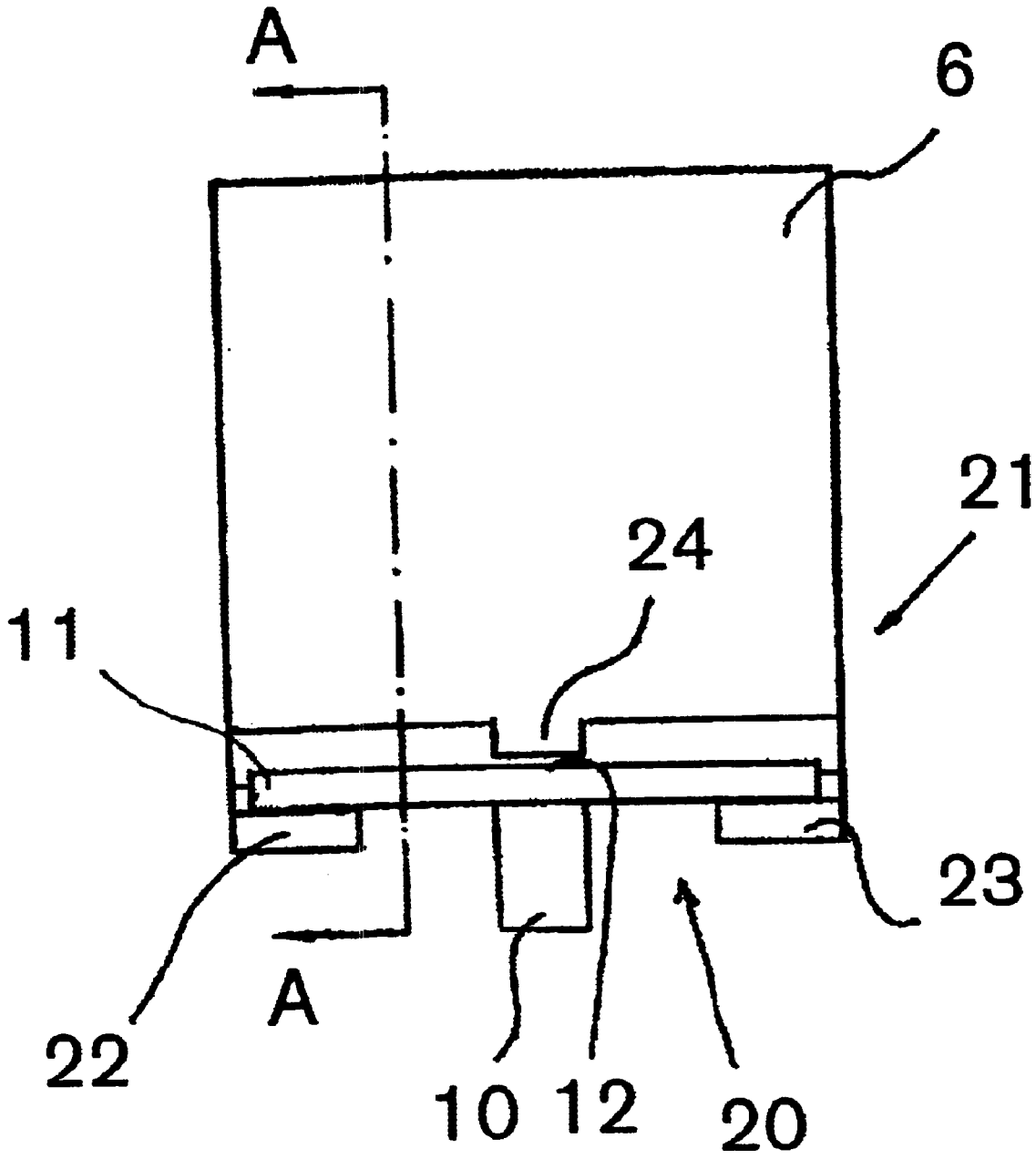
FIG. 3 is a schematic view of a staple magazine, seen from the front.

FIG. 3 shows the staple magazine 6 from the front, the outlet opening 20 being indicated in the figure. The feed channel 21 is indicated that includes a first channel guide 22 and a second channel guide 23, as well as a third channel guide 24. A staple blank 11 is shown in the feed channel 21 supported at its two outer sections or portions by channel guides 22 and 23, respectively. The third channel guide 24 is closely positioned to the top side of the staple blanks 11; that is, as a ramp-shaped guide, the third channel guide 24 asserts a downward pressure on the staple blanks 11 top side along the mid-section 12 region. FIG. 3 also exhibits the feed plate 10.

FIG. 4 shows the staple roll 17 stored in the staple magazine 6. The mode of storage, which is not shown in the figure, may be on a spindle or by any suitable arrangement familiar to the skilled in this art. The web 14, which extends from the staple roll 17 to the outlet opening 20, is supported in the view shown by the first channel guide 22.

Figure 5:
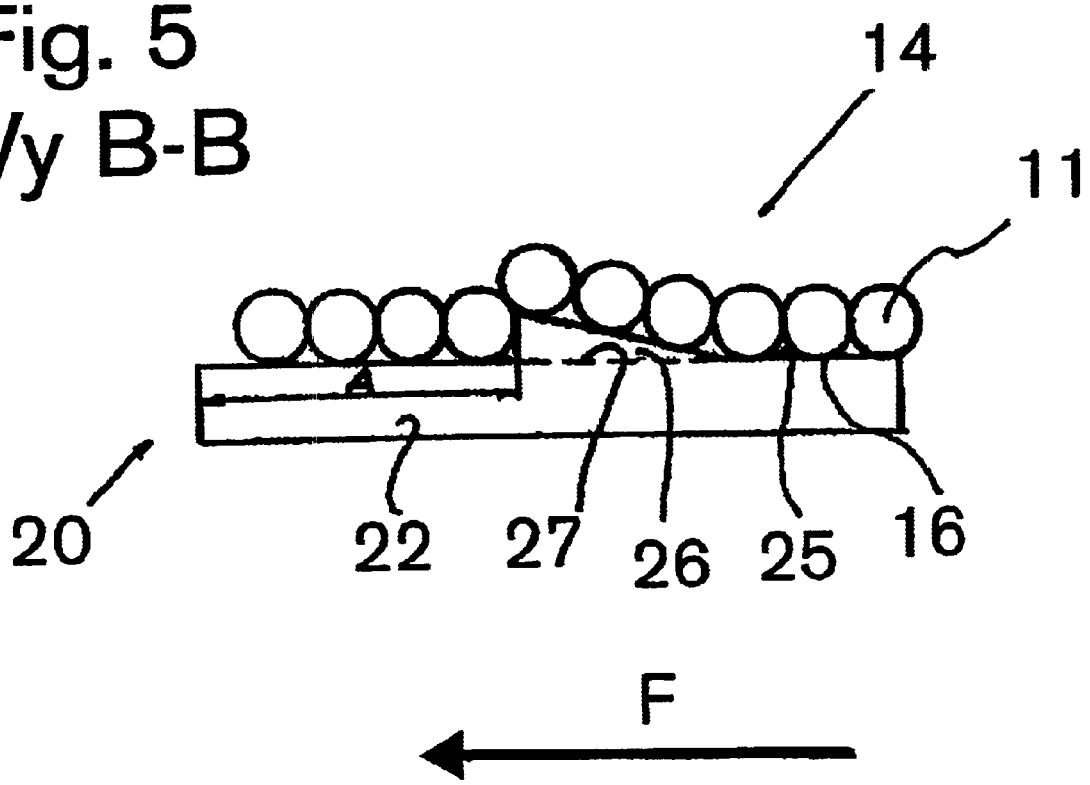
FIG. 5 is a detail view taken along line BB in FIG. 4.

FIG. 5 shows the feed channel 22, whose top surface 25 supports the underside 16 of the web 14. A stop 26 is located at a distance A from the outlet opening 20. The stop 26, which is shown integrally formed with the channel guide 22, has a triangular cross-section with one side of the triangle coinciding with the top surface 25 of the channel guide, shown by the dashed line 27 in FIG. 5.

Figure 6:
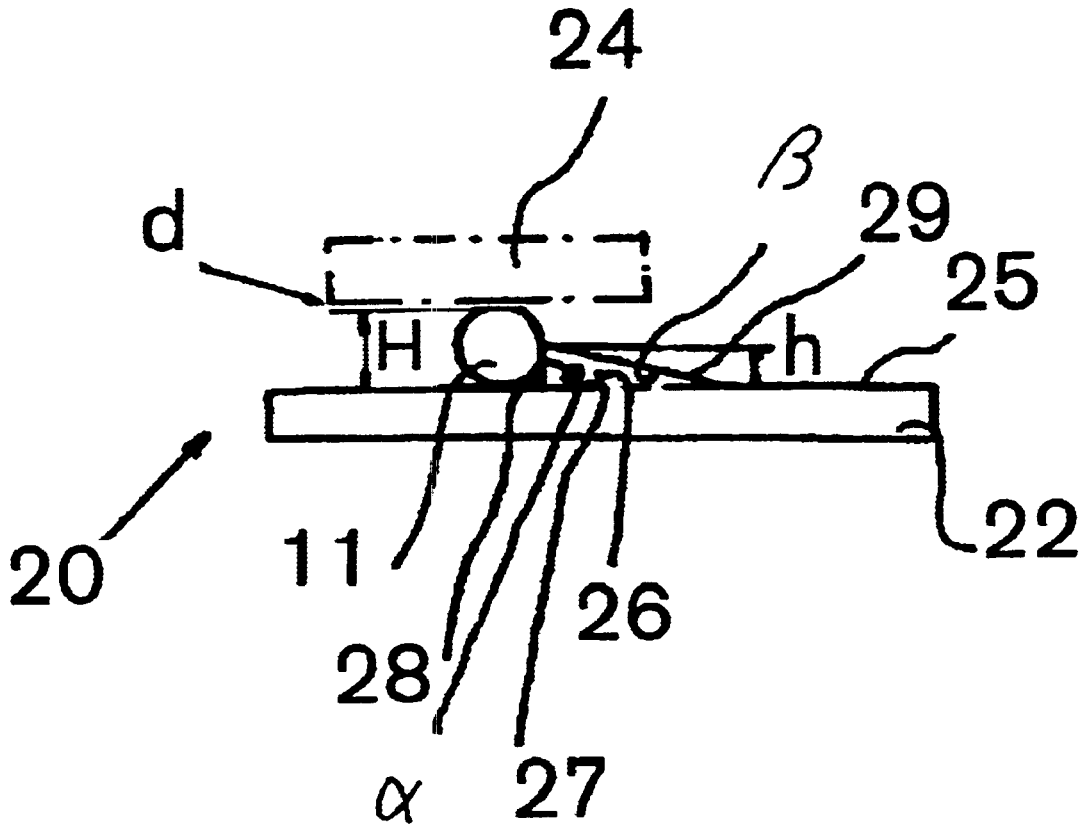
FIG. 6 is a detail view showing in cross-section a staple blank in position after having passed a stop which forms part of the invention.

FIG. 6 shows a staple blank 11 that has just passed the stop 26. The height of the staple blank 11 is indicated by H and the height of the stop 26 above the top surface 25 of the channel guide 22 is indicated by h. To assist reliable functioning of the invention, it is preferred that the height h of the stop 26 be at least half of the height H of the staple blank 11. The angle alpha, which indicates the angle between the lower side 27 of the stop 26 that is essentially coincident with the top surface 25 of the channel guide 22, and the substantially upright side 28 of the stop 26 nearest to the outlet opening 20, is exemplarily shown in the figure as a right angle. In a preferred embodiment, it has been found that the invention works best when this angle is substantially equal to 90 degrees. However, the invention also works satisfactorily when the angle is within the approximate range of 70 to 110 degrees. The angle beta between the third side 29 of the triangle, which serves as a ramp and whose function will be described below, and the side 27 preferably does not exceed 30 degrees. This side is shown in the figure as a straight line, but it should be appreciated that this side may be of alternative form, for example, concave in an upward direction with relation to the orientations established in the figures. It is also apparent from FIG. 6 that the third channel guide 24, indicated by the dash-dotted lines, is adjacent to the upper side of the staple blank 11 and it is clearly evident that the clearance d between the upper side 16 of the blank 11 and the lower surface of the channel guide 24 is negligible in relation to the height h of the ramped stop 26.

The above description relating to FIGS. 5 and 6 has been given referring to the one side of the magazine that contains the first channel guide 22; but it should also be appreciated that the description has as a counterpart a similar description of the opposite side of the magazine that contains the second channel guide 23.

Figure 7:
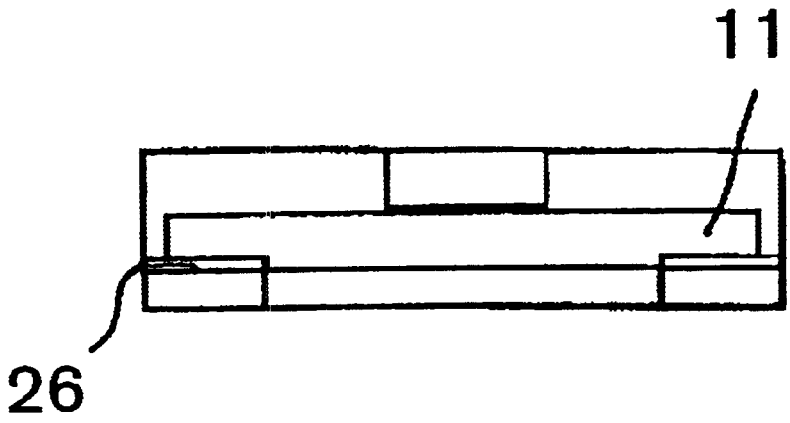
FIG. 7 shows the outlet opening of the staple magazine, seen from the front, with a staple blank in the position before it passes over the stops.
Figure 8:
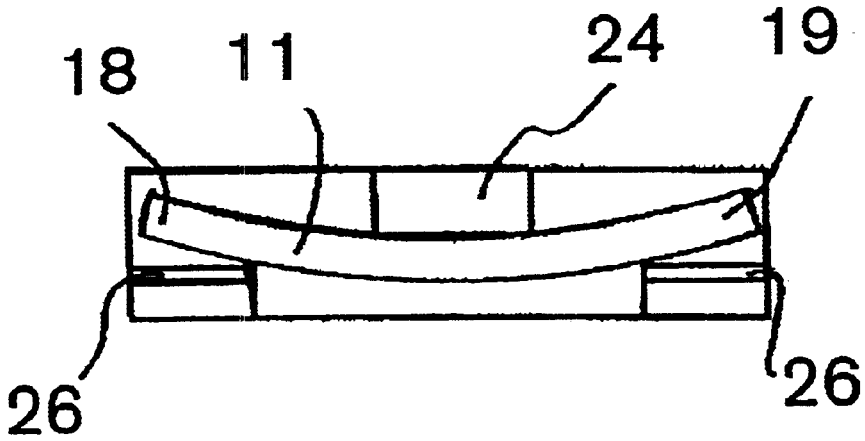
FIG. 8 is a view corresponding to FIG. 7, wherein the staple blank is located at the highest point of the stops.
Figure 9:
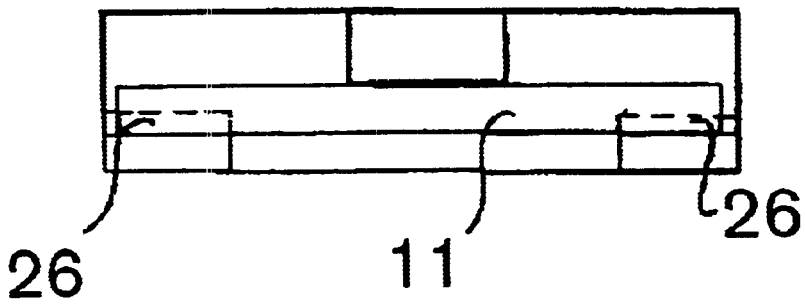
FIG. 9 is a view corresponding to FIGS. 7 and 8, wherein the staple blank has passed the stops.

FIG. 7 shows, looking from the outlet opening 20, a staple blank 11 in position before it passes over the stops 26. FIG. 8 shows the staple blank 11 in the position where it is at the highest point of the stops 26. In this position, the respective end portions or sections 18 and 19 of the staple blank 11 are bent upwards by the stops 26, while the mid-section 12 thereof is prevented from moving upwards by the channel guide 24. These flexures in the bodies of the blanks 11 are possible because the several staple blanks 11 are joined only at their mid-sections and, as previously indicated, are moveable at their outer portions in the direction of the double arrow T of FIG. 2. In FIG. 9, the staple blank 11 has passed the stops 26 and the outer portions 18 and 19 have returned to the position shown in FIG. 7.

The mode of operation of the invention will now be described with reference to FIGS. 19. The staple blanks 11 which are in the magazine 6 are fed out of the magazine with the aid of the feed device 7. After the blanks 11 have left the magazine 6, they are formed into staples (usually meaning the side portions or outer sections 18 and 19 are bent relative to the balance of the blank 11) and driven into work pieces placed on the anvil 3; but, since this is not essential to an understanding of the invention, no further explanation is provided. As the web 14, supported on the channel guides 22 and 23 is advanced by the feed device 7 in the direction indicated by the arrow F in FIG. 5, the outer sections 18 and 19 of the staple blanks 11, as they advance, strike the ramp surface 29. These outer sections 18 and 19 will then be raised relative to the corresponding mid-section 12, which is prevented from being raised by the restrictive channel guide 24 as shown in FIG. 8. After a staple blank 11 has passed the stops 26, the outer portions 18 and 19 return to their original position, as shown in FIG. 9. In this position, the staple blank 11 is in the position shown in FIG. 6, and because of the steep rake exhibited by the side 28, the staple blank 11 is unable to move in the direction opposite to direction F.

What is claimed is:

1. An anti-reversing device in a staple magazine (6) which is accommodated in a stapler (1) and which contains elongated staple blanks (11) which are separably joined (13) with each other along their long sides to form an elongated web (14) wherein the separable joint is disposed along the mid-sections (12) of the staple blanks and the outer sections (18, 19) of each staple blank are capable of limited movement relative to the outer sections of adjacent staple blanks and to their own aforementioned mid-section (12) in a direction which is transverse (1) to the lengthwise direction (L) of the web, the staple blanks being advanced stepwise by a feed device (7) along a feed channel (21) out of the magazine one at a time via a outlet opening (20), said feed channel consisting of at least a first channel guide (22) and a second channel guide (23) on which the elongated web of staple blanks advances, said first and second channel guides being respectively so positioned that they support respective outer portions of said web, and a third channel guide (24) which is closely positioned (d) to the web along the mid-sections thereof on that side (15) of the web which is opposite to the side (16) of the web which is supported by the first and second channel guides; the first and second channel guides (22, 23) exhibit at equal distances (A) from the outlet opening (20) respective integrated stops (26) which, as the web (14) advances, force the outer sections (18,19) of the advancing staple blanks to bend resiliently upwards relative to the mid-sections (12) thereof as the staple blanks pass over the stops, regaining their original positions once the stops are passed, whereby the staple blanks, having advanced, are prevented by the stops from moving in the direction opposite to the direction of feed (F).

2. An anti-reversing device according to claim 1, wherein each respective stop (26) has a height (h) above the top side (25) of the channel guide which is at least half of the height (H) of a staple blank (11).

3. An anti-reversing device according to claim 1, wherein each respective stop has a substantially triangular cross section wherein one side (27) of the triangle coincides with the top side (25) of the channel guide and the side (28) nearest to the outlet opening (20) has a rake angle alpha relative to side (27) which is in the approximate range from 70 to 110 degrees.

4. An anti-reversing device according to claim 3, wherein the angle alpha is 90 degrees.

* * * * *